United States Patent [19]

Valiulis et al.

[11] Patent Number: 4,869,376

[45] Date of Patent: Sep. 26, 1989

[54] INVENTORY CONTROL DEVICE FOR DISPLAY HOOK

[75] Inventors: Stanley C. Valiulis; Joseph W. Donnelli, both of Rockford, Ill.

[73] Assignee: Southern Imperial, Inc., Rockford, Ill.

[21] Appl. No.: 185,885

[22] Filed: Apr. 25, 1988

[51] Int. Cl.[4] ..... A47F 7/00

[52] U.S. Cl. ..... 211/59.1; 211/54.1; 248/220.4

[58] Field of Search ..... 248/220.4, 221.1, 221.2; 211/57.1, 54.1, 59.1, 59.4

[56] References Cited

U.S. PATENT DOCUMENTS

| | | | |
|---|---|---|---|
| 2,626,061 | 1/1953 | Girouard | 211/59 |
| 3,240,456 | 3/1966 | Hartman | 248/74.5 X |
| 3,308,961 | 3/1967 | Chesley | 211/49 |
| 3,780,873 | 12/1973 | Silva | 211/49 |
| 4,217,986 | 8/1980 | Brown | 248/220.4 X |
| 4,281,813 | 8/1981 | Garrity | 248/97 |
| 4,428,486 | 1/1984 | Collins | 211/59.1 A |
| 4,475,658 | 10/1984 | Roberts | 248/220.4 X |
| 4,540,093 | 9/1985 | Merl | 211/59.1 |
| 4,699,278 | 10/1987 | Klein | 248/222.1 X |

*Primary Examiner*—J. Franklin Foss

*Attorney, Agent, or Firm*—Leydig, Voit & Mayer

[57] ABSTRACT

A device for holding inventory near the forward end portion of a multi-arm display hook such as a scanner hook or a loop hook. The device is made of a single piece of wire having a bridge formed with an open hook at one end and a closed eye at the other end. The device is installed by slipping the eye onto one arm of the display hook and by hooking the open hook of the device around the other arm.

11 Claims, 1 Drawing Sheet

INVENTORY CONTROL DEVICE FOR DISPLAY HOOK

BACKGROUND OF THE INVENTION

This invention involves inventory control devices for display hangers or hooks of the type which are attached to a perforated panel such as a "Pegboard" and serve to hold and display retail merchandise.

Basically, there are three different types of display hooks which presently are in wide use. The first is a standard single arm wire hook of the type disclosed in Valiulis U.S. Pat. No. 3,912,084. The second is a so-called scanner hook of the type disclosed in Barnes U.S. Pat. No. 4,452,360. That hook includes a lower horizontally extending hanger arm for supporting merchandise and an upper parallel arm for supporting a price tag which may be "read" by an electronic scanning wand.

The third type of hook which presently is being widely used is a so-called loop hook. Such a hook is disclosed in Valiulis U.S. Pat. No. 4,560,062 and comprises a pair of horizontally spaced arms joined integrally at their outer ends and defining a U-shaped configuration when viewed from above.

Brown U.S. Pat. No. 4,217,986 discloses an inventory restraining device which may be used to keep the merchandise positioned near the outer end of a display hook. The Brown inventory control device is made of rubber or plastic and can be easily separated from the hook and dropped by a customer. Moreover, two control devices of the type disclosed in the Brown patent are required to restrain merchandise on the two arms of a loop hook.

SUMMARY OF THE INVENTION

The general aim of the present invention is to provide a new and improved inventory control device which is particularly adapted for use with scanner hooks and loop hooks, which may be made easily and inexpensively, which cannot be easily removed from the hook by a customer and which enables a scanner hook to support a greater load.

Another object of the invention is to provide an inventory control device adapted to coact with both arms of a loop hook to restrain merchandise thereon.

The invention also resides in the extremely simple and inexpensive construction of the inventory control device in the form of either a single piece of wire or a plastic extrusion.

These and other objects and advantages of the invention will become more apparent from the following detailed description when taken in conjunction with the accompanying drawings.

DETAILED DESCRIPTION OF THE PREFERRED EMBODIMENTS

Figure 1:
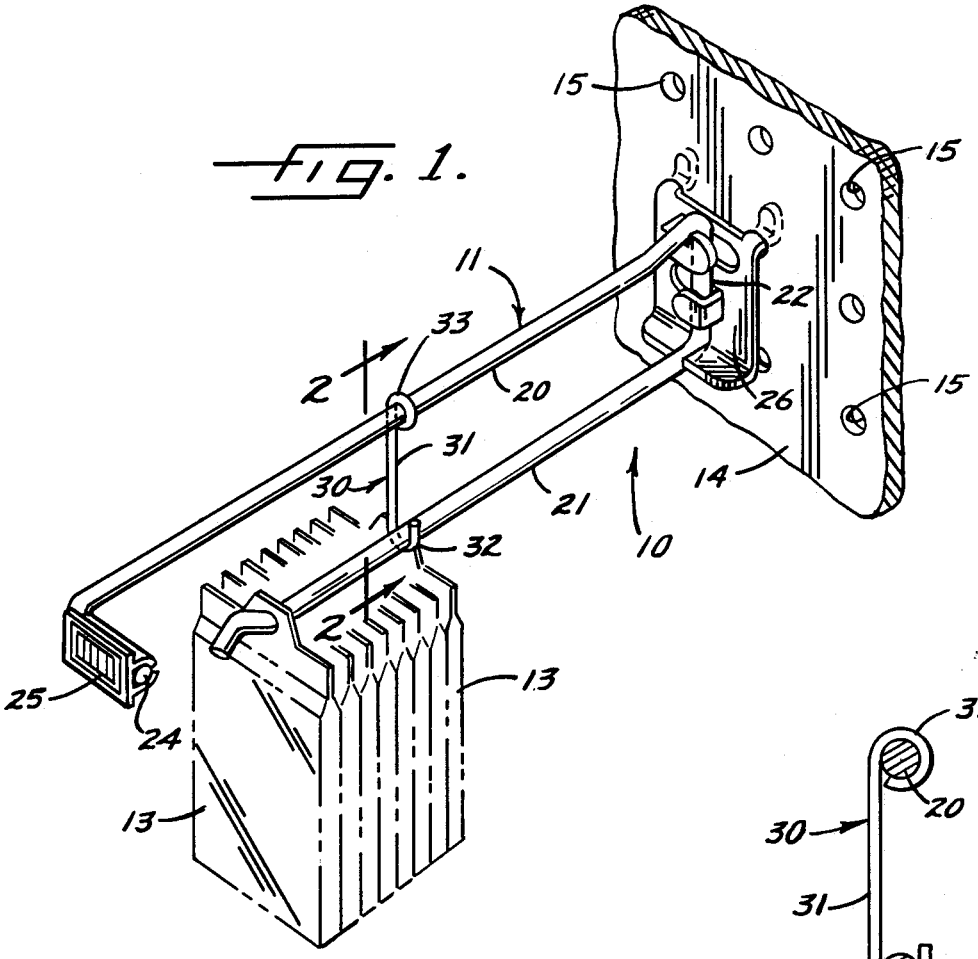
FIG. 1 is a perspective view of a typical scanner hook with one embodiment of a new and improved inventory control device incorporating the unique features the present invention.

For purposes of illustration, the invention has been shown in the drawings in connection with a hanger assembly 10 having a hanger 11 for supporting one or more articles 13 from a panel or "Pegboard" 14 of the type formed with a series of vertically spaced and horizontally extending rows of holes 15. In this instance, the articles have been illustrated as being bags within which merchandise is contained. The upper end portion of each bag is formed with a hole to enable the bag to be hung from the hanger 11.

Herein, the hanger 11 is generally U-shaped and is made of round wire. The hanger includes upper and lower outwardly projecting arms 20 and 21 whose inner ends are formed integrally with and are joined by an upright connecting piece or connector 22. The lower arm supports the articles 13 while the outer end of the upper arm is formed with a laterally projecting finger 24. A tag 25 is supported removably by the finger and contains indicia such as a price, a stock number or the like which is adapted to be "read" by an electronic inventory wand.

The hanger assembly 10 further comprises a mounting bracket 26 for attaching the hanger 11 releasably to the panel 14. In this instance, the bracket is of the type disclosed in Barnes U.S. Pat. No. 4,452,360 to which reference is made for a more detailed description.

The present invention contemplates the provision of a unique device 30 for keeping the bags 13 in a forward position on the hanger 11 and for preventing the bags from sliding rearwardly. The device is particularly characterized by its simplicity, by its ability to remain on the hanger and by its ability to help prevent the lower hanger arm 21 from flexing downwardly away from the upper arm 20.

Figure 2:
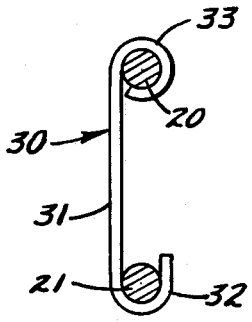
FIG. 2 is an enlarged cross-section taken along the line 2—2 of FIG. 1.

In the embodiment shown in FIGS. 1 and 2, the device 30 is made from a single piece of round wire and includes an elongated bridge 31. A loop in the form of a substantially open or C-shaped hook 32 is formed at one end of the bridge while another loop in the form of a substantially closed eye 33 is formed at the other end of the bridge.

To use the device 30, the eye 33 is slipped onto the upper hanger arm 20 either from the free end 24 thereof prior to installation of the label holder 25 or by sliding the eye along the arm 21, up the connector 22 and then onto the arm 20. The hook 32 then is hooked around the lower arm 21. The device 30 may be placed at any location along the arms 20 and 21 in order to keep the bags 13 positioned near the forward end portion of the arm 21.

The length of the device 30 is such that it tends to pull the arms 20 and 21 vertically toward one another. The wire arms inherently tend to spring away from one another and thus apply a frictional force to the hook 32 and the eye 33 to prevent the device 30 from sliding freely on the arms. At the same time, the device 30 helps prevent the lower arm 21 from flexing downwardly under the weight of the bags 13 or other merchandise and thus enables the arm 21 to support a heavier load.

By virtue of the eye 33 hanging from the upper arm 20, the device 30 merely hangs between the arms 20 and 21 if the hook 32 is released from the lower arm 21. If the eye 33 were on the lower arm 21, the device 30 would hang downwardly from the arm 21 if the hook 32 was released and might interfere with underlying merchandise.

Figure 3:
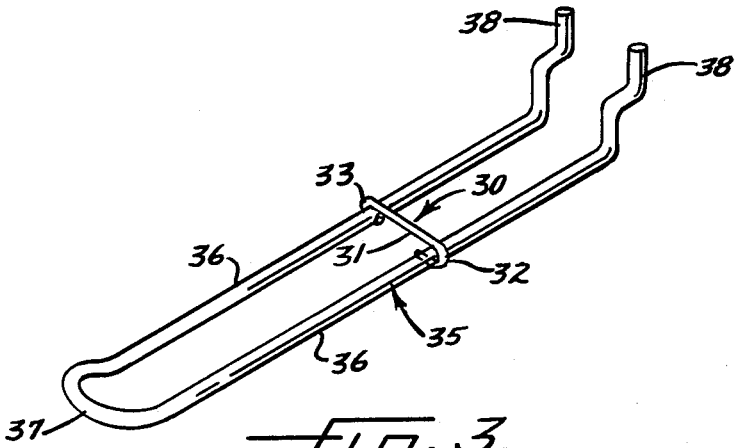
FIG. 3 is a perspective view of a typical loop hook equipped with the inventory control device.

As shown in FIG. 3, the device 30 also may be used to advantage with a loop-type hanger 35 of the type disclosed in Valiulis U.S. Pat. No. 4,560,062. Such a hanger comprises a pair of horizontally spaced and substantially parallel arms 36 which are integrally joined at their outer ends as indicated at 37. Substantially upright fingers 38 at the inner ends of the arms are used to attach the hanger releasably to a perforated panel.

The device 30 is used with the loop hook 35 simply by slipping the eye 33 onto one of the fingers 38 and then outwardly along the associated arm 36. The hook 32 then is hooked around the other arm. If the device is to be used exclusively with a loop hook, the hook 32 also may be in the form of a substantially closed loop or eye similar to the eye 33.

From the foregoing, it will be apparent that the present invention brings to the art a new and improved inventory restraining device 30 which may be simply formed from inexpensive wire. The device may be used equally well with a scanner-type hook 11 or a loop-type hook 35. As a result of the closed eye 33, the device tends to remain in place on the hook and is not easily lost from the hook.

Figure 4:
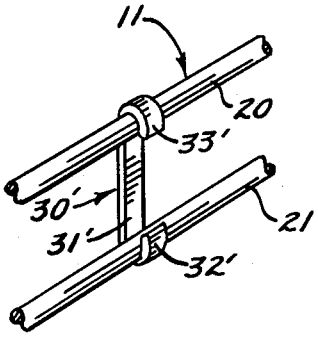
FIG. 4 is a fragmentary view similar to FIG. 1 but shows another embodiment of an inventory control device made in accordance with the invention.

FIG. 4 discloses another embodiment 30' of an inventory control device incorporating the features of the invention. The device 30' is a plastic extrusion having a bridge 31' with hooks 32' and 33' at the ends thereof. Several devices 30' may be formed as an elongated plastic extrusion which then is cut into pieces of predetermined length to form individual devices.

We claim:

1. The combination of, a hanger for displaying merchandise, and a device for holding the merchandise in a predetermined position on the hanger, said hanger comprising first and second elongated and substantially parallel arms having outer ends, said combination being characterized in that said holding device comprises a bridge extending between said arms, and first and second loops on the ends of said bridge and receiving said first and second arms, respectively, to prevent merchandise from sliding inwardly along the hanger.

2. The combination defined in claim 1 in which said first loop is substantially open and is sided and shaped to hook around said first arm, said second loop being a substantially closed eye and being capable of being inserted onto and removed from said second arm only when the second arm is moved endwise relative to said eye.

3. The combination defined in claim 1 in which said arms are capable of flexing resiliently toward and away from one another, the bridge of said holding device being of such length as to keep said arms toward one another and to restrict flexing of said arms away from one another.

4. The combination defined in claim 1 in which said bridge and said loops are made of a single piece of wire.

5. The combination defined in claim 1 in which said arms are substantially horizontal and are spaced vertically from one another, the bridge of said holding device extending vertically between said arms.

6. The combination defined in claim 1 in which said arms are substantially horizontal and are spaced horizontally from one another, said bridge extending horizontally between said arms.

7. The combination defined in claim 1 in which said bridge and said loops are made of a single piece of plastic.

8. The combination defined in claim 7 in which said holding device is a plastic extrusion.

9. The combination of, an elongated hanger for displaying merchandise, and a device for holding the merchandise in a predetermined position along the length of the hanger, said hanger comprising upper and lower elongated and vertically spaced arms having outer ends, said arms being made of resiliently yieldable wire and being capable of flexing toward and away from one another, said combination being characterized in that said holding device comprises an upright bridge extending between said arms, a hook on one end of said bridge and sized to hook around one of said arms, a substantially closed loop on the other end of said bridge and sized to slidably receive the other of said arms, said bridge being of such length as to keep said arms toward one another and to prevent said lower arm from flexing downwardly away from said upper arm, said holding device being operable to prevent merchandise from sliding inwardly along said hanger.

10. The combination defined in claim 9 in which said bridge, said hook and said loop are made of a single piece of wire.

11. The combination as defined in claim 9 in which said hook hooks around said lower arm, said loop receiving said upper arm.

* * * * *